US006796150B2

(12) United States Patent
Bringewatt et al.

(10) Patent No.: US 6,796,150 B2
(45) Date of Patent: Sep. 28, 2004

(54) INSTALLATION FOR THE WET-TREATMENT OF LAUNDRY, AND SEAL FOR SUCH AN INSTALLATION

(75) Inventors: Wilhelm Bringewatt, Bad Oeynhausen (DE); Falk F. Mehrmann, Walsrode (DE)

(73) Assignee: Pharmagg Systemtechnik GmbH, Hoya (DE)

( * ) Notice: Subject to any disclaimer, the term of this patent is extended or adjusted under 35 U.S.C. 154(b) by 134 days.

(21) Appl. No.: 10/010,513

(22) Filed: Nov. 5, 2001

(65) Prior Publication Data

US 2002/0083742 A1 Jul. 4, 2002

(30) Foreign Application Priority Data

Nov. 14, 2000 (DE) ..... 100 56 358

(51) Int. Cl.[7] ..... D06F 31/00
(52) U.S. Cl. ..... 68/24; 68/58; 68/142
(58) Field of Search ..... 8/158, 159; 68/24, 68/27, 58, 140, 142, 143; 134/61, 65, 66, 69, 132

(56) References Cited

U.S. PATENT DOCUMENTS 1,722,470 A * 7/1929 Jones
2,628,461 A * 2/1953 Heyman
3,103,802 A * 9/1963 Streich
3,219,969 A * 11/1965 Sulzmann
3,247,690 A * 4/1966 Kahn
3,815,257 A * 6/1974 Freze ..... 34/129
3,995,458 A * 12/1976 Gruenwald et al.
4,109,493 A * 8/1978 Hugenbruch
4,136,537 A * 1/1979 Harrsch
4,156,358 A * 5/1979 Harrsch
4,236,393 A * 12/1980 Katzfey
4,619,121 A * 10/1986 Mollerus et al.
4,856,302 A * 8/1989 Eck
5,025,645 A * 6/1991 Eck et al.
5,564,292 A * 10/1996 Geiger ..... 68/27

FOREIGN PATENT DOCUMENTS

DE 2527729 * 1/1977
DE 3631866 * 3/1988
DE 36 31 866 A 3/1988
DE 3710033 * 11/1988
DE 39 03 458 A1 8/1990
DE 41 06 621 A1 9/1992
DE 295 14 736 U1 12/1995
EP 1 081 267 A2 3/2001
JP 4-367697 * 12/1992

OTHER PUBLICATIONS

European Patent Office 541,464 May 1993.*
Europaischer Recherchenbericht (Nov. 3, 2003).

* cited by examiner

*Primary Examiner*—Frankie L. Stinson
(74) *Attorney, Agent, or Firm*—Technoprop Colton LLC

(57) ABSTRACT

A continuous washing machines (10) for industrial use having an inner drum (11), which can be driven in circulation, and an outer drum (22), which partially encloses said inner drum, with the outer drum (22) being formed from outer-drum sections (24) which are sealed in relation to the inner drum (11), in which the end sides (25) of the cylindrically designed outer-drum sections (24) are assigned seals (33, 24) which are fastened on the outside of the end regions of the casing of the outer-drum sections (24) by tension straps (45) such that the outer-drum sections (24) need not be specific configurations in the end regions and the seals (33, 34) can be adjusted simply by being displaced on cylindrical end regions of the outer-drum sections (24).

41 Claims, 2 Drawing Sheets

INSTALLATION FOR THE WET-TREATMENT OF LAUNDRY, AND SEAL FOR SUCH AN INSTALLATION

BACKGROUND OF THE INVENTION

1. Technical Field

The invention relates to an installation for the wet-treatment of laundry having an at least partially liquid-permeable inner drum which can be driven in circulation and has successive treatment chambers through which the laundry is directed during the wet-treatment; and a liquid-tight outer drum that encloses the inner drum at least partially is formed from outer-drum sections each extending over at least one of the treatment chambers, and a seal for such an installation, in particular a washing machine, namely, a seal for arranging between outer-drum sections of an outer drum of a washing machine which has an inner drum which can be driven in rotation and has successive treatment chambers.

2. Prior Art

The installations of the type mentioned here usually have an inner drum which can be driven in rotation and in which there are formed treatment chambers which follow one after the other in the longitudinal direction of the drum. The inner drum is of wholly or even just partially liquid-permeable design at least in the region of some treatment chambers. A liquid-tight outer drum is assigned to several treatment chambers of the inner drum. Liquid for treating the laundry is located between the inner drums and the outer drum. Seals are arranged between the treatment chambers in order that this liquid cannot pass in an uncontrolled manner from one treatment chamber to the other.

In the case of known washing machines, precise production of individual sections of the outer drum (outer-drum sections) is necessary in order that the seals ensure reliable sealing on partition walls between adjacent treatment chambers of the inner drum. Temperature-induced displacements of the outer-drum sections in relation to the inner drum may result, during operation of the washing machine, in the seals losing their effectiveness.

BRIEF SUMMARY OF THE INVENTION

The object of the invention, then, is to provide an installation for the wet-treatment of laundry (washing machine) and a seal which ensure permanent reliable sealing, and are cost-effective to produce and are straightforward to assemble and fit, respectively.

An installation for achieving this object has outer-drum sections that are enclosed, on their end sides, by seals that can be rotated in relation to the outer-drum section. On account of the displaceability of the seals, the latter can be adapted to the local conditions of the washing machine and automatically make allowances for production tolerances, in particular of the outer drum, but also of the inner drum. The seals can be fitted once the inner and the outer drums have been assembled. Finally, it is possible, with the seals partially worn, to rotate the entire seal into the bottom region of the outer drum, where only a sealing action is necessary because liquid only collects there. Worn seals are easily accessible from the outside and can be replaced with new ones without difficulty.

A further installation for achieving the object mentioned in the introduction has outer-drum sections that have cylindrical casing surfaces and seals assigned directly to cylindrical end border sections of the cylinder casing surfaces.

Accordingly, the outer-drum sections have cylindrical casing surfaces. The seals are assigned directly to the end sides of said cylindrical casing surfaces. There is therefore no need for specifically configured end-side regions of the outer-drum sections for accommodating the seals. Rather, it is possible for the seals to be assigned directly to the cylindrical border sections extending from the end sides of the outer-drum sections and to be fastened thereon.

By virtue of tensioning means for fastening the seals on the outer-drum sections, the seals only have to be of a very straightforward construction because they do not themselves have to have means by which they can be fastened on the outer-drum sections. The separate tensioning means may be very straightforward. In the simplest case, they may be tensioning struts. Furthermore, the separate tensioning means allow straightforward displacement of the seals relative to those parts of the washing machine which come into contact therewith.

In the case of a preferred installation, the seals have at least one cylindrical sealing section and a sealing means which is directed transversely thereto and is designed, for example, as an encircling sealing lip. The cylindrical sealing section of the respective seal makes it possible for the latter simply to be pushed preferably from the outside onto the likewise cylindrical border section of a corresponding end side of the outer-drum section. Positional deviations of the outer-drum sections, in particular of the end sides of the same, can easily be compensated for here in that the cylindrical sealing section of the respective seal can be pushed correspondingly far onto the cylindrical border section of the outer-drum section. By virtue of the seal being pushed, with the sealing section, onto the outer-drum section from the outside, the seal is kept in the envisaged position thereon even when the tension means has not yet been fitted.

Two adjacent outer-drum sections with spaced-apart end sides are connected in a liquid-tight manner by the seal, by virtue of the seal having a cylindrical section which, at opposite ends, has in each case one sealing section which, from the outside, overlaps a wall section of each of the two outer-drum sections which are to be connected by the seal. The seal ensures an elastic connection here for adjacent outer-drum sections which compensates for positional deviations of adjacent outer-drum sections and compensates elastically for changes in position of the outer-drum sections caused during the operation of the washing machine.

According to a preferred development of the installation according to the invention, at a distance from each opposite end side, the outer-drum sections are provided with an outer flange. The flanges are preferably located at a small distance from, and alongside, the cylindrical sealing section of each seal and are connected to one another in a mechanical, preferably releasable, manner. Adjacent outer-drum sections are preferably connected by spacers between mutually facing flanges for successive outer-drum sections. In this way, the outer drum sections are secured in a defined, form-fitting manner in relation to one another. The outer-drum sections thus form a mechanically connected unit which absorbs forces between adjacent outer-drum sections and, to this extent, relieves the seals between adjacent outer-drum sections of loading.

A seal for achieving the object mentioned in the introduction is distinguished by at least one sealing section for butting against the outside of a cylindrical casing of an outer-drum section of the washing machine and an elastically deformable sealing means for sealing adjacent treatment chambers of the inner drum preferably on one side.

Such a seal has a very straightforward construction and can easily be positioned, by way of the cylindrical sealing section, on the border section of an outer-drum section to which the seal is to be assigned.

Seals between two adjacent outer-drum sections of which the mutually facing end sides are spaced apart from one another by a small distance have a cylindrical section which has in each case one sealing section on opposite sides and a central section between adjacent end sides of the outer-drum sections, to which the sealing means is assigned. The two sealing sections can easily be formed by the cylindrical section. The cylindrical section of the seal thus forms an elastic connection between the two adjacent outer-drum sections. The central section between the adjacent sealing sections allows the sealing means, in particular a sealing lip, to be connected integrally to the central section of the seal. A preferred exemplary embodiment of the invention is explained in more detail hereinbelow with reference to the drawing, in which:

DETAILED DESCRIPTION OF THE PREFERRED EMBODIMENTS

Figure 1:
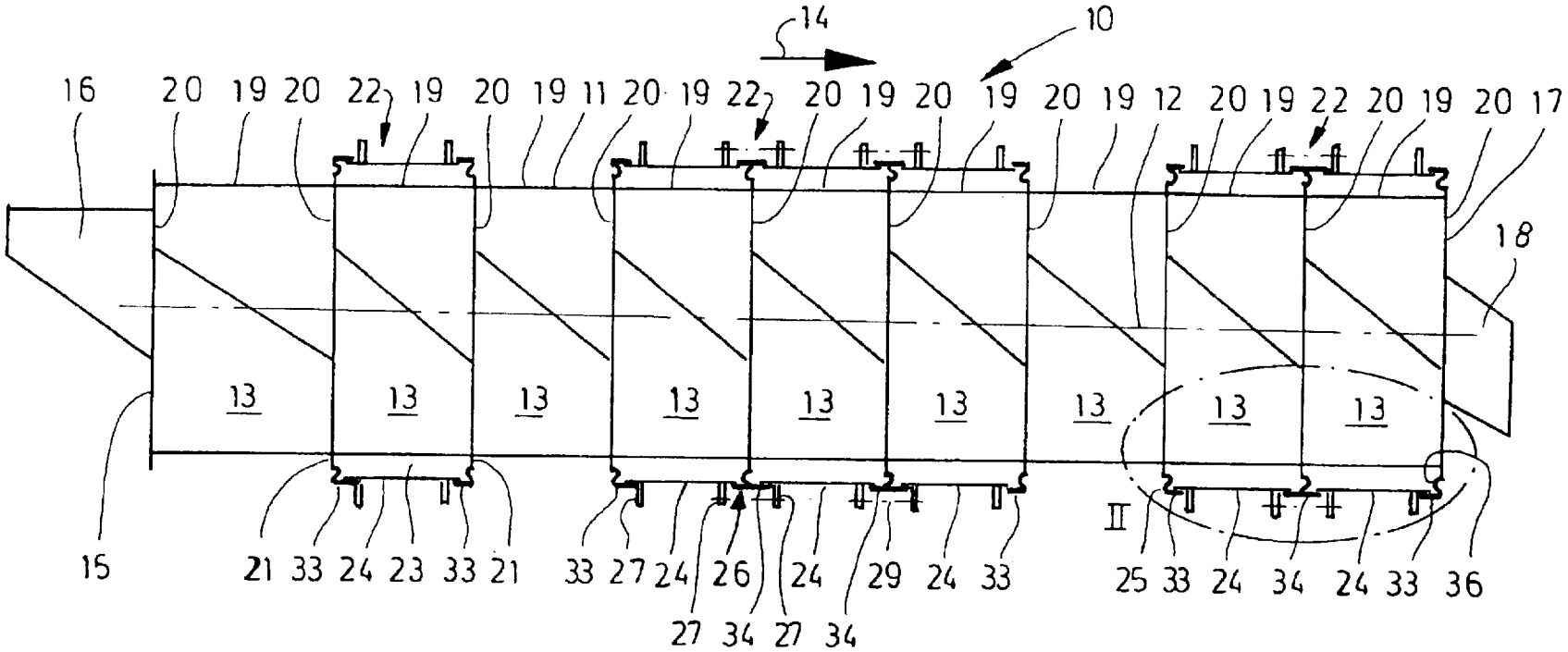
FIG. 1 shows a schematic side view of the installation, namely of a continuous washing machine.

The installation shown here is a continuous washing machine 10 which is used predominantly in industrial laundries. In the continuous washing machine 10, items of laundry (not illustrated in the figures) are washed, rinsed and, if appropriate, aftertreated in batches.

The continuous washing machine 10 has an elongate inner drum 11 which can be driven in rotation about a horizontal longitudinal center axis 12. The inner drum 11 of the continuous washing machine 10 is subdivided into different treatment chambers 13, which define different zones for treating the items of laundry. These are, for example, a prewash zone, a main-wash zone, a rinsing zone and, if appropriate, an aftertreatment zone. The individual treatment chambers 13 are arranged one after the other in the inner drum 11 of the continuous washing machine 10 as seen in the treatment direction 14, which runs in the direction of the longitudinal center axis 12 of the inner drum 11. The number of successive treatment chambers 13 per zone may vary depending on the size and capacity of the continuous washing machine 10.

An introduction hopper 16 is arranged upstream of an introduction end 15, which is on the left-hand side in FIG. 1, of the continuous washing machine 10. A discharge chute 18 is assigned to the discharge end 17, which is on the right-hand side of FIG. 1, of the inner drum 11.

The single-piece inner drum 11 is formed, inter alia, from cylindrical drum section 19. Each drum section 19 serves for forming a treatment chamber 13. The walls of the drum sections 19 may be of wholly or partially liquid-permeable design, that is to say they may have corresponding perforation holes. Annular disk plates 20, which are located in a vertical plane running perpendicularly to the longitudinal center axis 12, are arranged between the individual drum sections 19 for forming the treatment chambers 13. The disk plates 20 are connected, to be precise preferably welded in a liquid-tight manner, to end sides of the cylindrical drum sections 19. The disk plates 20 have an external diameter which is greater than the external diameter of the cylindrical casings of the drum sections 19, with the result that, between two successive treatment chambers 13, an annular section 21 of each disk plate 20 projects outward in relation to the cylindrical casing surface of the inner drum 11. In the region of some treatment chambers 13, the inner drum 11 is enclosed by a fixed, liquid-tight outer drum 22. The outer drum 22 is assigned in a stationary manner to the inner drum 11. As FIG. 1 shows, the outer drum 22 is only assigned to parts of the inner drum 11, namely to certain treatment chambers 13 of the inner drum 11. Provided between the larger-diameter outer drum 22 and the inner drum 11 are accommodating spaces 23 for liquid from the inner drum 11, which is wholly or partially liquid-permeable at least in the regions of the outer drum 22.

The outer drum 22 is formed from individual outer-drum sections 24. Each of the outer-drum sections 24, which are preferably of identical design, has a cylindrical casing. The diameter of the cylindrical outer-drum section 24 is somewhat larger than the external diameter of the disk plates 20 between two drum sections 19 of the inner drum 11. The length of the cylindrical outer-drum sections 24 is somewhat shorter than the distance between two disk plates 20 on opposite sides of the respective treatment chamber 13. This produces an interspace 26 between in each case two mutually facing, round end sides 25 of successive outer-drum sections 24. The cylindrical outer-drum sections 24 terminate directly on the opposite, round end sides 25. Accordingly, in the case of the invention, the end sides 25 of the outer-drum sections 24 are not of any specific configuration, in particular are not provided with end pieces or connection pieces. Accordingly, the end sides 25 merge smoothly in a flush manner into the cylindrical outer-drum section 24.

The cylindrical casing of each outer-drum section 24 is enclosed on the outside by two annular flanges 27. The two preferably identically designed annular flanges 27 of each outer-drum section 24 are arranged at a distance from a border section 28 extending from the respective end side 25 of the cylindrical casing. The distances between the annular flanges 27 and the end sides 25 are equal in each case. The annular flanges 27 are connected, preferably welded, to the cylindrical lateral surface of the outer-drum section 24, it being possible for said welding to take place at certain points or in certain regions, that is to say it does not have to be liquid-tight.

Adjacent outer-drum sections 24 are connected to one another at mutually facing annular flanges 27. For this purpose, use is made of screw-connections 29 which are distributed at preferably regular intervals on the circumference of the annular flanges 27. Spacers are arranged between annular flanges 27 which are connected to one another. In the exemplary embodiment shown (FIG. 2), said spacers are spacer sleeves 30. These are supported on mutually facing side surfaces of the annular flanges of the outer-drum sections 24 which are to be connected, and thus define the distance between the outer-drum sections 24, in particular the mutually facing end sides 25 of the same, and thus the width of the interspace 26. Extending through the respective spacer sleeve 30 is a bolt 31 with a nut 32, by means of which the respective screw-connection 29 is closed and presses the two annular flanges 27 against the respective spacer sleeve 30 from both sides.

The outer drum 22 is sealed in relation to the inner drum 11, to be precise in a liquid-tight manner. In the exemplary embodiment shown, the sealing takes place such that it is not only the case that the exposed outer end sides 25 of the outer-drum sections 24 are sealed; rather, seals are also located between successive outer-drum sections 24, as a result of which liquid-tight sealing takes place not just in the outward direction of the treatment chambers 13, but also between the treatment chambers 13. In the exemplary embodiment shown, the treatment chambers 13 of the inner drum 11 are sealed in relation to the outer-drum sections 24 by two different seals 33 and 34. The seals 33 serve for sealing a free end side 25 at a respective lateral end of an outer outer-drum section 24 of the outer drum 22 in relation to the inner drum 11. The seals 34 create a seal between two successive outer-drum sections 24 of the outer drum 22, on the one hand, and between the outer drum 22 and the inner drum 11, on the other hand.

The seals 33 and 34 are formed from an elastic material, for example rubber or an elastomer, it being possible for the rubber or elastomer to be provided, if appropriate, with reinforcing inserts. The seals 33 and 34 either are routed cylindrically in an endless manner around the respective outer-drum section 24 or are formed from an open-ended strand which is positioned in an annular manner around the relevant end side 25 of the respective outer-drum section 24, it being possible for the ends of the seals 33, 34 to be connected to one another with sealing action and thus to be rendered endless.

The seals 33, which are arranged at the free ends of the outer drum 22, have a cylindrical sealing section 35 and a sealing means which is integrally formed thereon and, in the exemplary embodiment shown, is a sealing lip 36. The sealing lip 36 is connected to an end of the sealing section 35 which is oriented in the direction of the disk plate 20 of the inner drum 11 assigned to it. The sealing lip 36 has a shallow V-shaped cross section. An encircling free end of the sealing lip, which is oriented away from the sealing section 35, forms a sealing edge 37 which butts with prestressing, and thus with sealing action, against the vertical wall surface 38 of the disk plate 20, said wall surface being oriented into the interspace 26. The sealing nut 36 which is designed and arranged in the manner described is located in the interspace 26, at least partially filled with liquid, between the inner drum 11 and the outer drum 22 and, accordingly, is pressed, by way of the sealing edge 37, against the wall surface 38 by the pressure of the liquid in the interspace 26, in order to enhance the sealing action.

The sealing section 35 of the seal is of cylindrical design and dimensioned such that it encloses the outer-drum section 24, preferably with prestressing, in an annular manner from the outside in the border section 28 extending from the respective end side 25. The sealing section 35 is of such a length that it is located at a distance upstream of the annular flange 27 on that side of the outer-drum section 24 which is provided with the seal 33. It is thus possible for the seal 33 to be displaced, by way of the sealing section 35, on the border section 28 of the outer-drum section 24 in the direction of the longitudinal center axis 12 of the inner drum 11, to be precise such that the sealing edge 37 of the sealing lip 36 butts, with sufficient prestressing, against the wall surface 38 of the disk plate 20.

Figure 2:
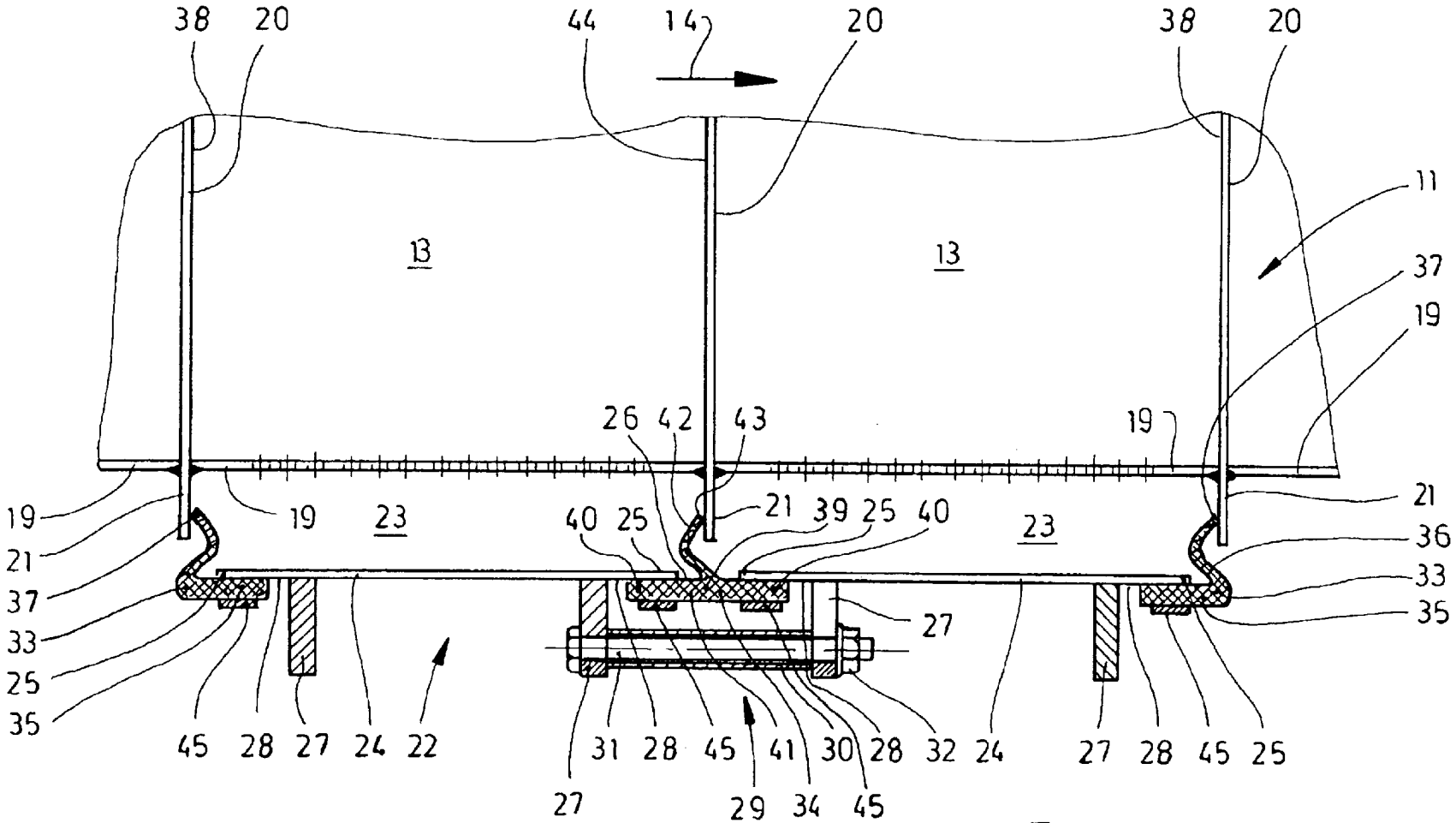
FIG. 2 shows on an enlarged scale, a detail II from FIG. 1.

The seal 34 between two successive outer-drum sections 24 connects mutually facing end sides 25 of two adjacent outer-drum sections 24. For this purpose, the seal 34 is provided with a cylindrical section 39, which is longer than the seal 33. The cylindrical section 39 extends from the border section 28 of one outer-drum section 24 to the border section 28 of the adjacent outer-drum section 24 (FIG. 2). For this purpose, the cylindrical section 39 of the seal 34 has sealing sections 40 arranged at its opposite ends. The cylindrical section 39 has a central section 41 between the two sealing sections 40. The two sealing sections 40 enclose in an encircling manner the outside of in each case one border section of adjacent outer-drum sections 24. The central section 41, which is located between the sealing sections 40, is located in the region of the interspace 26 between mutually facing end sides 25 of adjacent outer-drum sections 24. A sealing lip 42 is likewise integrally formed on the central section 41 of the single-piece cylinder section 39. The sealing lip 42 corresponds to the sealing lip 36. The sealing lip 42 extends in an annular manner through the interspace 26 and, by way of a sealing edge 43, butts, with elastic prestressing and with sealing action, against a wall surface 44 of the disk plate 20 between adjacent treatment chambers 13 which are enclosed by the outer-drum sections 24 connected by the seal 34. The single sealing lip 42 of the seal 34 is sufficient in order wholly, or at least predominantly, to avoid liquid exchange between the accommodating spaces 23 between the inner drum 11 and the outer drum 22 of adjacent treatment chambers 13. If the liquid level in the accommodating space 23 in which the sealing lip 42 of the seal 34 is located (left-hand accommodating space 23 in FIG. 2) is higher than in the adjacent accommodating space 23 (right-hand accommodating space 23 in FIG. 2), the hydrostatic pressure gradient results in the sealing lip 42 being pressed, by way of the sealing edge 43, against the wall surface 44 of the disk plate 20 and thus in the sealing action being enhanced. It is only if there is a higher liquid level in the accommodating space 23 from which the sealing lip 42 is directed away (right-hand accommodating space 23 in FIG. 2) than in the adjacent space 23 with the sealing lip 42 (left-hand accommodating space 23 in FIG. 2) that it is possible for the sealing action of the sealing lip 42 to be reduced by the hydrostatic gradient. On account of the elastic prestressing of the sealing lip 42, however, the sealing action is then usually still sufficient for no liquid exchange, or only minimal liquid exchange, to take place between the accommodating spaces 23 of different adjacent treatment chambers 13. Such liquid exchange which may possibly occur can be tolerated.

The cylindrical section 39 on mutually facing border sections 28 of adjacent outer-drum sections 24 serves for sealing the interspace 26 in a liquid-tight manner between the adjacent outer-drum sections 24. However, the elastic properties of the seal 34, in particular of the cylindrical section 39 of the same, make it possible to compensate, beyond the interspace 26, for positional deviations of the adjacent outer-drum sections 24 or movements of the same during the operation of the continuous washing machine 10. Overloading of the seal 34 is prevented here by the screw-connections 29 between adjacent outer-drum sections 24. The screw-connections 29 transmit mechanical forces between adjacent outer-drum sections 24, with the result that the cylindrical section 39 of the seal 34, for connecting and for sealing adjacent outer-drum sections 24, remains essentially unloaded in mechanical terms. The cylindrical section 39 of the seal 34 thus only performs its intended task of connecting outer-drum sections 24 with sealing action.

The seals 33 and 34 are fixed on the corresponding end sides 25 of the outer-drum sections 24 and prestressed with sealing action by tensioning straps 45. The construction and functioning of such tensioning straps 45 are known in principle. The tensioning straps 45 may be in a single piece. For easier fitting, however, the tensioning straps 45 are designed preferably in a number of parts, for example from four parts which are connected to one another in a releasable manner by clamping screws and each extend over a quarter of the circumference of the respective seal 33, 34 and/or of the outer-drum section 24. The tensioning straps 45 are assigned to the respective sealing sections 35 and 40 of the seals 33, 34. The tensioning straps 45 are preferably of such a width that they overlap that part of the sealing section 35 or 40 which butts against the outside of the border section 28 extending from the respective end side 25 of the relevant outer-drum section 24. In this way, that region of the sealing section 35 or 40 which is overlapped by the tensioning strap 45 is arranged between the tensioning strap 45 and the border section 28 extending from the respective end side 25 of the relevant outer-drum section 24. Corresponding tensioning of the tensioning strap 45 causes reduction in diameter of the same and thus causes the sealing sections 35, 40 of the seals 33, 34 to be pressed against the outside of the cylindrical outer-drum section 24, to be precise with elastic prestressing at least of parts of the sealing sections 35, 40. This brings about permanent and reliable sealing of the respective seal 33, 34 on the end border sections 28 of the outer-drum sections 24. Moreover, the sealing sections 35, 40 of the seals 33, 34 are thus secured against displacement on the cylindrical outer-drum sections 24. If it is intended, in the case of a partially worn seal 33, 34, to increase the prestressing by which the respective sealing edges 37 and 43 of the respective sealing lips 36 and 42 butt against the respective wall surfaces 38 and 44 of the disk plates 20, that is to say to readjust the seal 33, 34, this can take place by the tensioning straps 45 being released and the seals 33, 34 being correspondingly displaced on the outer-drum sections 24, in the direction of the longitudinal center axis 12 of the inner drum 11. The respective tensioning strap 45 can then be tensioned again in order to arrest the adjusted position of the seals 33, 34 on the border sections 28 of the outer-drum sections 24. It is also possible, in the abovedescribed manner, to rotate the seals 33, 34 relative to the outer-drum sections 24 if there is wear on the sealing edges 37, 43 of the sealing lips 36, 42 in the region of the accommodating spaces 23.

What is claimed is:

1. An installation for wet-treatment of laundry, having an at least partially liquid-permeable inner drum that can be driven in circulation and in which there are formed successive treatment chambers through which the laundry can be directed during the wet-treatment, and having a liquid-tight outer drum that encloses the inner drum at least in certain regions and is formed from outer-drum sections each extending over one treatment chamber, wherein the outer-drum sections (24) are enclosed on their end sides (25) by seals (33, 34), that are rotatable in relation to the outer-drum sections (24), and the seals re fastened on the outer-drum sections by tensioning means.

2. The installation as claimed in claim 1, wherein the seals (33, 34) have at least one cylindrical sealing section (35, 40) and a transversely directed sealing means.

3. The installation as claimed in claim 1, wherein at least one seal (34) is located between spaced-apart, mutually facing end sides (25) of adjacent outer-drum sections (24), the seal (34) having a cylindrical section (39) with sealing sections (40) at opposite ends, and each of the sealing sections (40) butting with sealing action from the outside against a border section (28) extending from each end side (25) of the outer-drum section (24).

4. The installation as claimed in claim 1, wherein the seal (34) comprises a central section (41) arranged between sealing sections (40), and the central section (41) is located between spaced-apart end sides (25) of two adjacent outer-drum sections (24), with the sealing sections (40) and the central section (41), in a continuous formation, forming the cylindrical section (39).

5. The installation as claimed in claim 4, wherein a sealing means is arranged integrally on the central section (41) and is directed radially inward in relation to the cylindrical central section (41).

6. The installation as claimed in claim 5, wherein the sealing means of each of the seals (33, 34) is a single sealing lip (36, 42).

7. The installation as claimed in claim 1, wherein each of the seals (33, 34) has at least one sealing section (35, 40) and is connected with sealing action on at least part of its sealing section to a corresponding border section (28) of the outer-drum section (24) by the tensioning means.

8. The installation as claimed in claim 7, wherein the at least one sealing section (35, 40) is cylindrical and the tensioning means is a tensioning strap (45) that encloses the respective cylindrical sealing section.

9. The installation as claimed in claim 8, wherein the tensioning strap (45) encloses the respective cylindrical sealing section (35, 40) from the outside and tightens the sealing section (35, 40) with sealing action against the outside of cylindrical casing surfaces of the respective outer-drum section (24).

10. The installation as claimed in claim 8, wherein before being enclosed by the respective tensioning strap (45) the respective seal (33, 34) is displaceable in the axial direction of the outer-drum section (24) such that the sealing lips (36, 42) butts, with elastic prestressing, against a sealing surface of the inner drum (11).

11. The installation as claimed in claim 1, wherein at least one of the outer-drum sections has a free end side that does not have any adjacent outer-drum section located opposite it and, on the free end side of the at least one outer-drum section (24) that does not have any adjacent outer-drum section (24) located opposite it, the seal has a sealing lip (36) that can be forced against a corresponding sealing surface (38, 44) of a corresponding round panel (20) of the inner drum (11) by liquid between the inner drum (11) and the outer drum (22).

12. An installation for the wet-treatment of laundry, having an at least partially liquid-permeable inner drum that can be driven in circulation and in which there are formed successive treatment chambers through which the laundry can be directed during the wet-treatment, and having a liquid-tight outer drum that encloses the inner drum at least in certain regions and is formed from outer-drum sections each extending over one treatment chamber, wherein (a) the outer-drum sections (24) are enclosed, on their end sides (25), by seals (33, 34) that can be rotated in relation to the outer-drum sections (24), (b) at a distance from each of the end sides (25), the outer-drum sections (24) have an outer annular flange (27) located at a small distance from, and alongside, sealing section (35, 40) of the respective seals (33, 34), and (C) adjacent annular flanges (27) of two successive outer-drum sections (24) are connected to one another.

13. The installation as claimed in claim 12, wherein the annular flanges (27) of adjacent outer-drum sections (24) are connected by spacers.

14. An installation for wet-treatment of laundry, having an at least partially liquid-permeable inner drum that can be driven in circulation and in which there are formed successive treatment chambers through which the laundry can be directed during the wet-treatment, and having a liquid-tight outer drum that encloses the inner drum at least in certain regions and is formed from outer-drum sections each extending over one treatment chamber, wherein the outer-drum sections (24) have cylindrical casing surfaces, and seals (33, 34) are assigned directly to cylindrical end border sections (28) of the cylindrical casing surfaces and the seals are fastened on the outer-drum sections by tensioning means.

15. The installation as claimed in claim 14, wherein the seals (33, 34) have at least one cylindrical sealing section (35, 40) and a transversely directed sealing means.

16. The installation as claimed in claim 14, wherein at least one seal (34) is located between spaced-apart, mutually facing end sides (25) of adjacent outer-drum sections (24), the seal having a cylindrical section (39) with sealing sections (40) at opposite ends, and each of the sealing sections (40) butting with sealing action from the outside against a border section (28) extending from each end side (25) of the outer-drum section (24).

17. The Installation as claimed in claim 14, wherein the seal (34) comprises a central section (41 arranged between the sealing sections (40), and the central section (41 ), is located between spaced-apart end sides (25) of two adjacent outer-drum sections (24), with the sealing sections (40) and the central section (41), in a continuous formation, forming the cylindrical section (39).

18. The installation as claimed in claim 17, wherein a sealing means is arranged integrally on the central section (41) and is directed radially inward in relation to the cylindrical central section (41).

19. The installation as claimed in claim 18, wherein the sealing means of each of the seals (33, 34) is a single sealing lip (36, 42).

20. The installation as claimed in claim 14, wherein each of the seals (33, 34), has at least one sealing section (35, 40) and is connected with sealing action on at least part of its sealing section to a corresponding border section (28) of the outer-drum section (24) by the tension means.

21. The installation as claimed in claim 14, wherein the at least one sealing section (35, 40) is cylindrical and the tensioning means is a tensioning strap (45) that encloses the respective cylindrical sealing section.

22. The installation as claimed in claim 21, wherein the tensioning strap (45) encloses the respective cylindrical sealing section (35, 40) from the outside and tightens the sealing section (35, 40) with sealing action against the outside of cylindrical casing surfaces of the respective outer-drum section. (24).

23. The installation as claimed in claim 21, wherein before being enclosed by the respective tensioning strap (45) the respective seal (33, 34) is displaceable in the axial direction of the outer-drum section (24) such that the sealing lips (36, 42) butts, with elastic prestressing, against a sealing surface of the inner drum (11).

24. The installation as claimed in claim 14, wherein at least one of the outer-drum sections has a free end that does not have any adjacent outer-drum section located opposite it and, on the free end side of the at least one outer-drum section (24) that does not have any adjacent outer-drum section (24) located opposite it, the seal has a sealing lip (36).

25. An installation for wet-treatment of laundry, having an at least partially liquid-permeable inner drum that can be driven in circulation and in which there are formed successive treatment chambers through which the laundry can be directed during the wet-treatment, and having a liquid-tight outer drum that encloses the inner drum at least in certain regions and is formed from outer-drum sections each extending over one treatment chamber, wherein (a) the outer-drum sections (24) have cylindrical casing surfaces, and seals (33, 34) are assigned directly to cylindrical end border sections (28) of the cylindrical casing surfaces, (b) at a distance from each of the end sides (25) the outer-drum sections (24) have an outer annular flange (27) located at a small distance from, and alongside, sealing section (35, 40) of the respective seals (33, 34), and (c) adjacent annular flanges (27) of two successive outer-drum sections (24) are connected to one another.

26. The installation as claimed in claim 25, wherein the annular flanges (27) of adjacent outer-drum sections (24) are connected by spacers.

27. A seal for arranging between outer-drum sections an outer drum of a washing machines, the washing machine having an inner drum that is driven in rotation and that has successive treatment chambers, the seal comprising at least one cylindrical sealing section (35, 40) for butting against the outside of a cylindrical casing of a corresponding outer-drum section (24), an elastically deformable sealing means for sealing the respective treatment chamber (13) of the inner drum (11) on one side and a tensioning means for fastening the seal on the outer-drum sections.

28. The seal as claimed in claim 27, wherein the seal further comprises a cylindrical section (39) that has sealing sections (40) located at opposite ends and a central section (41) located between the sealing sections (40).

29. The seal as claimed in claim 28, wherein the seal further comprises a single deformable sealing means designed as a sealing lip (36, 42) that is connected integrally to the sealing section (35).

30. The seal as claimed in claim 28, wherein the seal further comprises a single deformable sealing means designed as a sealing lip (36, 42) that is connected integrally to the central section (41).

31. An installation for wet-treatment of laundry, having an at least partially liquid-permeable inner drum that can be driven in circulation and in which there are formed successive treatment chambers through which the laundry can be directed during the wet-treatment, and having a liquid-tight outer drum that encloses the inner drum at least in certain regions and is formed from outer-drum sections each extending over one treatment chamber, wherein the outer-drum sections (24) are enclosed on their end sides (25) by seals (33, 34) that are displaceable in relation to the outer-drum sections (24) and the seals are fastened on the outer-drum sections by tensioning means.

32. The installation as claimed in claim 31, wherein the seals (33, 34) have at least one cylindrical sealing section (35, 40) and a transversely directed sealing means.

33. The installation as claimed in claim 31, wherein at least one seal (34) is located between spaced-apart, mutually facing end sides (25) of adjacent outer-drum sections (24), the seal (34) having a cylindrical section (39) with sealing sections (40) at opposite ends, and each of the sealing sections (40) butting with sealing action from the outside against a border section (28) extending from each end side (25) of the outer-drum section (24).

34. The installation as claimed in claim 31, wherein the seal (34) comprises a central section (41) arranged between sealing sections (40), and the central section (41) is located between spaced-apart end sides (25) of two adjacent outer-drum sections (24), with the sealing sections (40) and the central section (41), In a continuous formation, forming the cylindrical section (39).

35. The installation as claimed in claim 34, wherein a sealing means is arranged integrally on the central section (41) and is directed radially inward in relation to the cylindrical central section (41).

36. The installation as claimed in claim 35, wherein the sealing means of each of the seals (33, 34) is a single sealing lip (36, 42).

37. The installation as claimed in claim 36, wherein the at least one sealing section (35, 40) is cylindrical and the tensioning means is a tensioning strap (45) that encloses the respective cylindrical sealing section.

38. The installation as claimed in claim 37, wherein the tensioning strap (45) encloses the respective cylindrical sealing section (35, 40) from the outside and tightens the sealing section (35, 40) with sealing action against the outside of cylindrical casing surfaces of the respective outer-drum section (24).

39. The installation as claimed in claim 37, wherein before being enclosed by the respective tensioning strap (45) the respective seal (33, 34) is displaceable in the axial direction of the outer-drum section (24) such that the sealing lips (36, 42) butts, with elastic prestressing, against a sealing surface of the inner drum (11).

40. The installation as claimed in claim 39, wherein at least one of the outer-drum sections has a free end side that does not have any adjacent outer-drum section located opposite it and, on the free end side of the at least one outer-drum section (24) that does not have any adjacent outer-drum section (24) located opposite it, the seal has a sealing lip (36) can be forced against a corresponding sealing surface (38, 44) of a corresponding round panel (20) of the inner drum (11) by liquid between the Inner drum (11) and the outer drum (22).

41. The installation as claimed in claim 31, wherein each of the seals (33, 34) has at least one sealing section (35, 40) and is connected with sealing action on at least part of its sealing section to a corresponding border section (28) of the outer-drum section (24) by the tensioning means.

* * * * *